US006273793B1

(12) United States Patent
Liners et al.

(10) Patent No.: US 6,273,793 B1
(45) Date of Patent: Aug. 14, 2001

(54) APPARATUS AND METHOD FOR REDUCING DISC SURFACE ASPERITIES TO SUB-MICROINCH HEIGHT

(75) Inventors: William O. Liners, Minnetonka; Mark J. Schaenzer, Eagan, both of MN (US)

(73) Assignee: Seagate Technology LLC, Scotts Valley, CA (US)

( * ) Notice: Subject to any disclaimer, the term of this patent is extended or adjusted under 35 U.S.C. 154(b) by 0 days.

(21) Appl. No.: 09/404,984

(22) Filed: Sep. 22, 1999

Related U.S. Application Data

(60) Provisional application No. 60/100,903, filed on Sep. 23, 1998.

(51) Int. Cl.[7] ..... B24B 1/00

(52) U.S. Cl. ..... 451/41; 451/63; 451/317; 451/319; 451/552; 451/557; 451/901; 29/90.01; 29/90.3

(58) Field of Search ..... 451/41, 63, 317, 451/319, 552, 557, 901, 49; 29/90.01, 90.3

(56) References Cited

U.S. PATENT DOCUMENTS

| | | | | |
|---|---|---|---|---|
| 4,330,910 | | 5/1982 | Schachl et al. . | |
| 4,845,816 | * | 7/1989 | Nanis | 29/90.01 |
| 5,063,712 | * | 11/1991 | Hamilton | 451/173 |
| 5,658,191 | * | 8/1997 | Brezoczky | 451/324 |
| 5,782,680 | * | 7/1998 | Pilsan | 451/317 |
| 5,873,947 | | 2/1999 | Mohindra et al. . | |

* cited by examiner

*Primary Examiner*—Joseph J. Hail, III
*Assistant Examiner*—Shantese McDonald
(74) *Attorney, Agent, or Firm*—Merchant & Gould P.C.

(57) ABSTRACT

A honing head for microburnishing surface of a recording/reproducing disc to a smoothness at which asperities are limited to submicron heights including a hardened contact bearing surface having an array of depressions with abrupt trailing edges interconnected by recessed channels leading outwardly from the honing head. The array of channels span a band in which an asperity may be present, and the sharp edges shear off the asperities within the band which extend above the chosen submicroinch height, with the separated particulates being passed through the recesses and channel system to the outer edge of the honing head. The trailing edges act to shear off the unwanted heights of the asperities, while the recesses enable pressure differentials and air flows to direct the separated particulates outwardly relative to the disc, centripetal forces of rotation bearing the particulates from the disc. A diamond-like coating on the entire contact bearing surface and the recesses aids in reducing wear and the stiction of the smooth surfaces to the disc that is being burnished. This arrangement has the further advantage that the honing head may be prepared by photomicrolithographic techniques to generate the array of recesses on a production basis, with the recesses having precisely determined depths and perpendicular trailing edge walls. Ion milling and other known techniques can be used to remove the materials in the chose patterns quickly and efficiently.

10 Claims, 6 Drawing Sheets

APPARATUS AND METHOD FOR REDUCING DISC SURFACE ASPERITIES TO SUB-MICROINCH HEIGHT

REFERENCE TO PRIOR APPLICATION

This application relies for priority on a previously filed provisional application, Ser. No. 60/100,903, filed in Sep. 23, 1998.

FIELD OF THE INVENTION

This invention relates to the microfinishing of surfaces, and particularly to the reduction of minute discontinuities or asperities on the surface of discs used in the recording and reproduction of data.

BACKGROUND OF THE INVENTION

As hard disc recording and reproduction systems for digital data processing have evolved, there have been continuing increases in track density and longitudinal recording density, such that data recording capacities have increased by orders of magnitude. A fundamental factor in achieving these results has been the development of transducers which are supported by air bearings at very small flying heights (1 microinch or less) above the surface of the disc. The aerodynamics of the pad facing the disc, and a sensitive and precise gimbal support arm, facilitate noncontact operation with these minute gaps which in turn provides extremely efficient coupling between the transducer and the active surface (whether magnetic or magneto-optical) of the disc.

As advances have been made in these respects, corollary advances have also been made in disc manufacture, and in manufacturing processes and test procedures, to enable the disc surfaces to be essentially planar, to a high degree of precision. The discs are mass produced, enabling the virtually universal adoption of hard disc files for data processors in small and large capacity systems to become feasible because of the very low cost and very high performance levels which have been reached. The discs may be single sided or double sided, as they are burnished and finished to a given smoothness. With submicroinch flight heights, however, burnishing alone is not satisfactory, because very minor irregularities, typically called asperities, still can exist. These must either be eliminated before the disc can be installed, or the disc must be rejected for use.

Automated test beds have been devised for use in a final honing procedure for these high capacity hard discs. These test beds include "glide head" mechanisms, each glide head having a sensitive force sensor so that, with the glide head flying above the disc surface at a given height (at the order of a microinch or less) asperities can be detected. The disc is rotated at angular velocities typical for normal operations, giving surface rates of 400 ips to 600 ips, depending upon radial position. The glide head is scanned across the active recording surface of the disc, with the sensor generating a signal excursion whenever an asperity is encountered. Depending on the amplitude and duration of the signal excursion, these asperities can be categorized (as for example "hard" hits or "soft" hits) and the instrumentation system can identify the radius for future processing. At this point, a honing head, supported by a gimbal arm to be radially movable, is also scanned across the disc, specifically to those radial positions at which asperities had been detected. The honing head typically has small projections from a flat surface, and flat contact areas on the projections that are separated by grooves, such that the edges of the projections engage and hone the asperities.

Such honing head designs, however, have disadvantages that become most apparent when attempting to provide a surface for recording/reproduction head operation at submicroinch levels. Highly polished flat surfaces in contact induce forces of molecular attraction between them, and thus introduce stiction effects which can render operation non-uniform. In addition, with a honing head of this design the top increment of an asperity may be separated from its base, but is not necessarily removed from the disc itself, thus representing an object that can possibly interfere with signal transduction.

After honing head operation, the disc is again tested by the glide head and instrumentation system, to verify that asperities beyond the chosen threshold have been eliminated. Thereafter, the disc can be approved for use in a production unit. These processes are carried out in clean room conditions and the discs are confined within closed environments with air properly filtered to remove all but very minute particle sizes which can be tolerated.

SUMMARY OF THE INVENTION

Devices, systems and methods in accordance with the invention utilize the trailing edges of an array of recesses formed in a planar like surface having an anti-stiction coating and including a plurality of channels leading from the recesses to the radially outward portion of the honing head. The recesses preferably converge toward the trailing edge, with straight or curved sides, and shear off the apices of asperities, the channels causing particulate matter to flow radially outwardly from the honing head and to be urged by centripetal forces off the disc. Air trapped under the leading edge of the honing head merely raises its leading edge minutely, but the angle assists the shearing action by the subsequent trailing edges. Concurrently, the recesses in the outwardly angled channels are under negative pressure relative to the surrounding ambient pressure, drawing the asperities from the surface of the disc and toward the airflow region adjacent the honing head that is created by the high speed disc.

In a more particular example of devices and methods in accordance with the invention, useful in eliminating asperities so that recording heads can fly at altitudes of 0.5 microinch or less, the recesses are essentially diamond shaped trenches, each having a trailing edge defined by converging sides of the diamond. Each trench of this type has dimensions of about 168 microns by 168 microns, and a depth of 10 to 20 microns, while the overall configuration of the pad is 40 mm by 80 mm in this practical example. The honing head is mounted at the end of a gimbal arm, and urged toward the disc with a pressure which depends upon head area, in this instance about 6.5 grams. The channels extend at an angle toward the trailing edge and are a depth corresponding to the trenches, and so angled that they intercept each of a series of intervening trenches along the path to the external radius. The surface of the honing head incorporates a diamond like coating (dlc) which hardens the surface, improves the shearing action and enhances uniformity of operation because it substantially reduces the stiction effect. Alternatively, superior results have also been achieved with trenches that are curved, e.g. oval, in configuration, and the advantages are also preserved in other geometries, such as triangular trenches which have an apex at the trailing edge.

Honing heads of this character may readily be fabricated using photolithographic techniques, as by depositing a photosensitive resist material on a planar head, exposing the photoresist material through a photographic mask to leave a removable pattern corresponding to the trenches and channels, and then removing the material by ion milling, acid etching or plasma etching to form straight sides for shearing, and recesses of the chosen depth. After the honing head has been processed to this extent, the dlc material is applied, readying the head for attachment in the assembly in use.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 1:
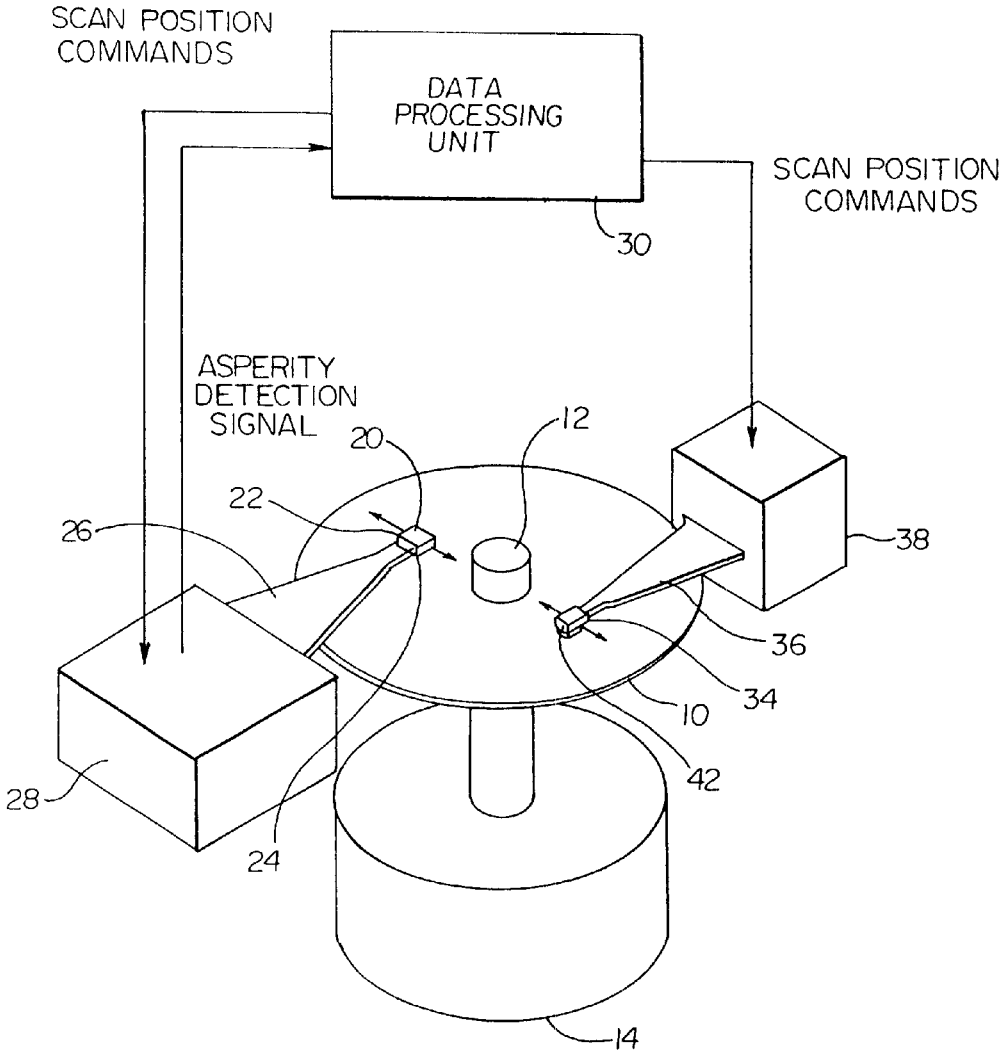
FIG. 1 is a simplified perspective view of a test bed assembly employing a honing head in accordance with the invention.

In a typical test bed instrumentation system, utilized in a high level clean room environment, a disc 10 that has been burnished and is to be honed is mounted on a spindle 12 and rotated by a drive motor 14 at an angular velocity giving a surface velocity of 400–600 ips depending upon radius, this surface velocity corresponding to typical recording system operations. For a three and one half inch disc, the rotational rate is approximately 6000–9000 rpm. The system includes a glide head 20, having a narrow dynamic slider 22 and incorporating a sensitive force sensor, such as a PZT device 24, mounted by a gimbal on the end of an arm 26 which is moved between radial extremes on the disc 10 by a rotary arm or other scanning mechanism 28. Signals detected by the PZT sensor are fed to a data processing system 30 which controls the rate of radial increment of both the scanning mechanism 28 and a honing mechanism described below. The data processing system 30 includes conventional signal processing circuits for measuring the height of signal excursions generated by the PZT sensor 24 on encountering asperities, and conventional means for storing the radial locations of the asperities.

Figure 2:
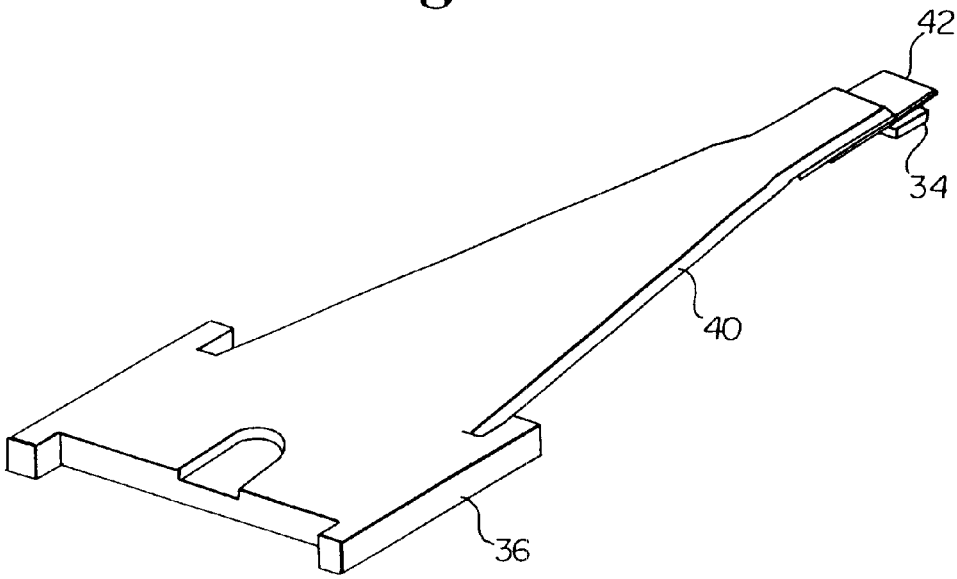
FIG. 2 is a perspective view showing the principal elements of a honing head in accordance with the invention.
Figure 3:
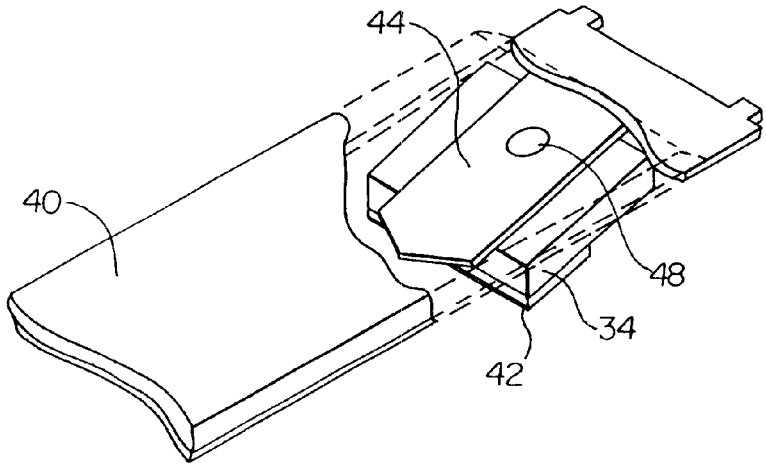
FIG. 3 is a fragmentary perspective view of a portion of the honing head of FIG. 2, showing further details thereof.

A small honing head 34 is gimbaled on the end of a positioning arm 36 that is moved by a honing head control mechanism 38 under signals from the data processing system 30. The general arrangement of the honing head 34 is depicted in FIGS. 2 and 3, to which reference may now be made. The positioning arm has a thin but still inflexible body 40 overlying a metal base strip 42 near the free end of which is a gimbal cutout 44 in the base strip 42, defining a support for the honing head 34 which flexes slightly toward and away from the disc when in operation. On the superior side of the gimbal cutout 44 is a dimple 48 which limits upward flexure of the gimbal cutout 44 and the honing head 34 because the body 40 acts a physical limit when engaged by the dimple 48.

Figure 4:
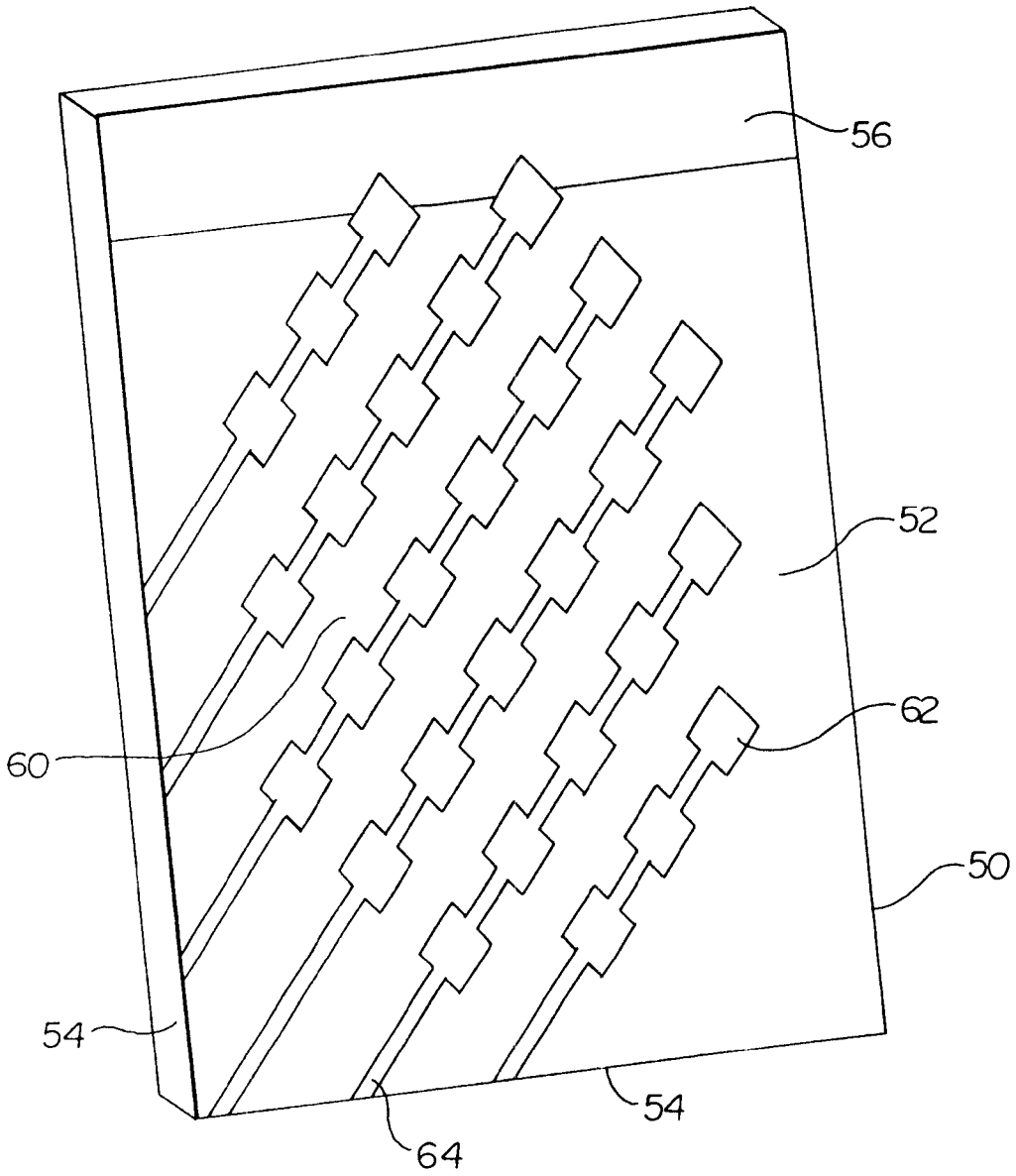
FIG. 4 is a plan view of the contact side of a honing head in accordance with the invention.

With reference to FIG. 4, the honing head 34 includes a slider pad 50 of substantially rectangular shape, which, in this example, has dimensions of about 80 mls by 63 mls by 17 mls. A bearing surface 52 on the contact side of the slider pad 50 is perpendicular to the outer wall 54 of the slider pad 50, except at a tapered leading edge 56, which includes a chamfer at an angle of 8 microrad and having a length in the direction of relative movement of approximately 10 mls.

Figure 5:
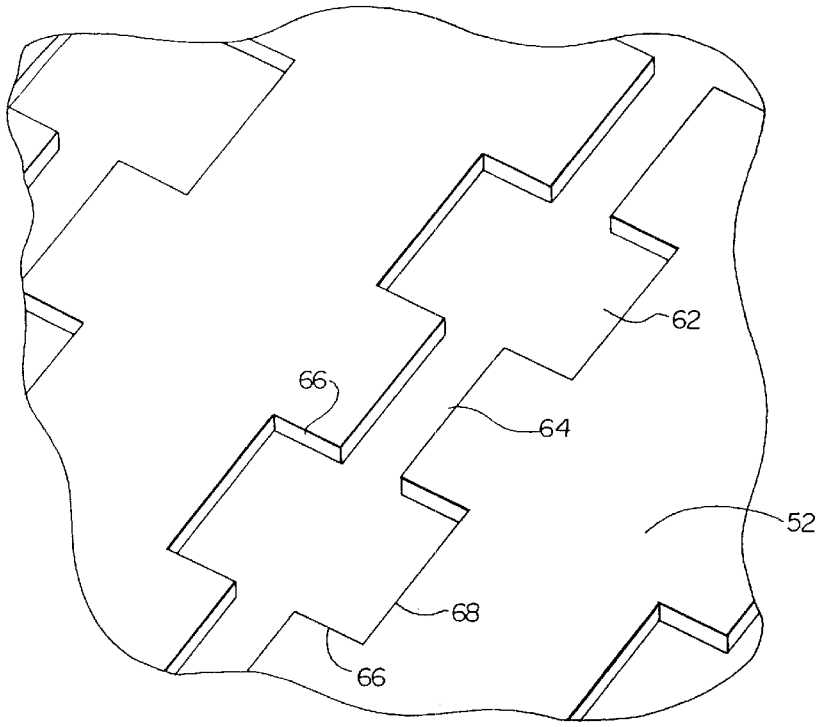
FIG. 5 is a fragmentary perspective view of the contact side of a honing head in accordance with the invention, showing the active portions of a trench and channel arrangement in the head.

As seen in FIGS. 4 and 5, viewing the contact side of the slider pad 50, the bearing surface 52 comprises an array 60 of concavities or depressions in the otherwise substantially planar surface. The array 60 is of circular or oval outline, to minimize edge chipping and reduce edge effects thereby substantially reducing the risk of damage to the disc media. The concavities and depressions, in this example, are diamond shaped trenches 62, one corner of which points in the direction of the leading edge 56, while the trailing edge portions provide shearing walls and accessible space for collecting particles from asperities as will be described hereinafter. The trenches 62 are arrayed so that they overlap laterally within the array outline so as to assure coverage of a radial band of the disc when the honing head 34 is at a particular position. The trenches 62 are interconnected by channels 64 that pass through rows of the trenches in a trailing edge direction that leads to the outside wall 54 of the slider pad 50.

The trenches 62 preferably have diagonal dimensions of about 208 microns by 264 microns and depths of about 10–20 microns (14 microns in this example). Using micro lithographic techniques as described hereafter, the trenches 62 have vertical back (trailing edge) walls 66 with shearing edges 68. The channels 64, which have depths corresponding to the depths of the trenches, are shown with exaggerated depths for clarity in FIG. 5. The entire surface of the slider pad 50 is treated with a known diamond like coating (dlc), which not only enhances the hardness of the surface and reduces wear rates, but also reduces any tendency toward stiction and provides an inert surface which helps to eliminate generation and redistribution of particle contamination on the disc surface. The dlc coating in this instance is applied after the trenches and channels are formed, and preferably is in a 75/25 ratio.

Figure 6:
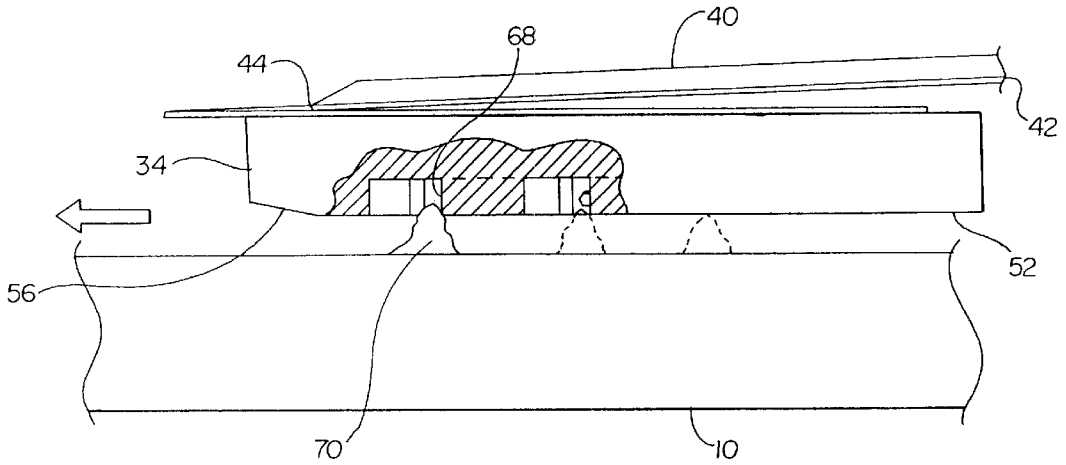
FIG. 6 is a simplified perspective view of the shearing action on an asperity of a honing head in accordance with the invention, the elements being shown in greatly exaggerated form.

In the usage of this honing head, as in the context of the sensing and honing approach used in the FIG. 1 system, the honing head 34 is held in contact against the surface of the disc 10 at the chosen radial position at which an asperity has been detected. A force of approximately 6.5 grams is used in this example, based upon the surface area of the slider pad 50, which is proportionately smaller than prior honing heads. Experience has shown that the contact force can be reduced in proportion to slider pad contact area. In this instance the load of 6.5 grams provides some 15,033 g/in$^2$ of actual surface contact pressure on the media. Where an asperity is to be removed, and especially in the case of the "hard hits", the shearing action of the back wall of the trenches 62 levels off the apex of the asperity, shown in somewhat idealized form in FIG. 6. Since the objective is to allow submicron flight height on the recording and reproduction transducer head, the elevation of asperity tips or apices above the nominal disc surface must be lowered, and particularly in a fashion to provide a relatively level surface. The shearing edges 68 defined by the trench back walls 66 provide just such a function, since the bearing surface 52 will pass over asperities 70 of lesser submicron height, but only until a certain height is reached, at which level the shearing edges 66 of trailing trenches in the array shear off the excessive portions. At the speeds of rotation used for the disc, the tapered leading edge 56 of the pad allows a minimal amount of air to raise the leading edge slightly, thus facilitating this successive shearing action.

The sheared matter in the form of minute particulates, of course, cannot be allowed to either remain on the disc or function to clog the honing head. In this respect, the trenches 62 and channels 64 greatly facilitate the cleaning action of the honing head and disc, since there are both air pressure differentials and air flows, as well as centripetal forces, which tend to disperse the particulates in a direction away from the disc 10. Air moving as a boundary layer with the disc creates slightly negative pressure in the trenches 62 and channels 64, thus initially accumulating particulates in the trenches, until air flow along the channels to the outer wall of the slider pad removes the particulates, after which the centripetal force of the disc rotation impels the particulates to the outer radius and off the disc. If any particulates do remain within the trenches or channels they are readily removable when the honing head is cleaned.

Thus, the honing head in accordance with the present invention improves disc surface tribology so as to augment the aerodynamic performance of read/write heads while reducing head vibration due to asperities. Given that the asperities are only of the order of 0.6 microinches or less, the improvement of stable maintenance of ultralow flying heights which this honing action in parts enables very high density recording and reproduction with minimal head crash.

Figure 7:
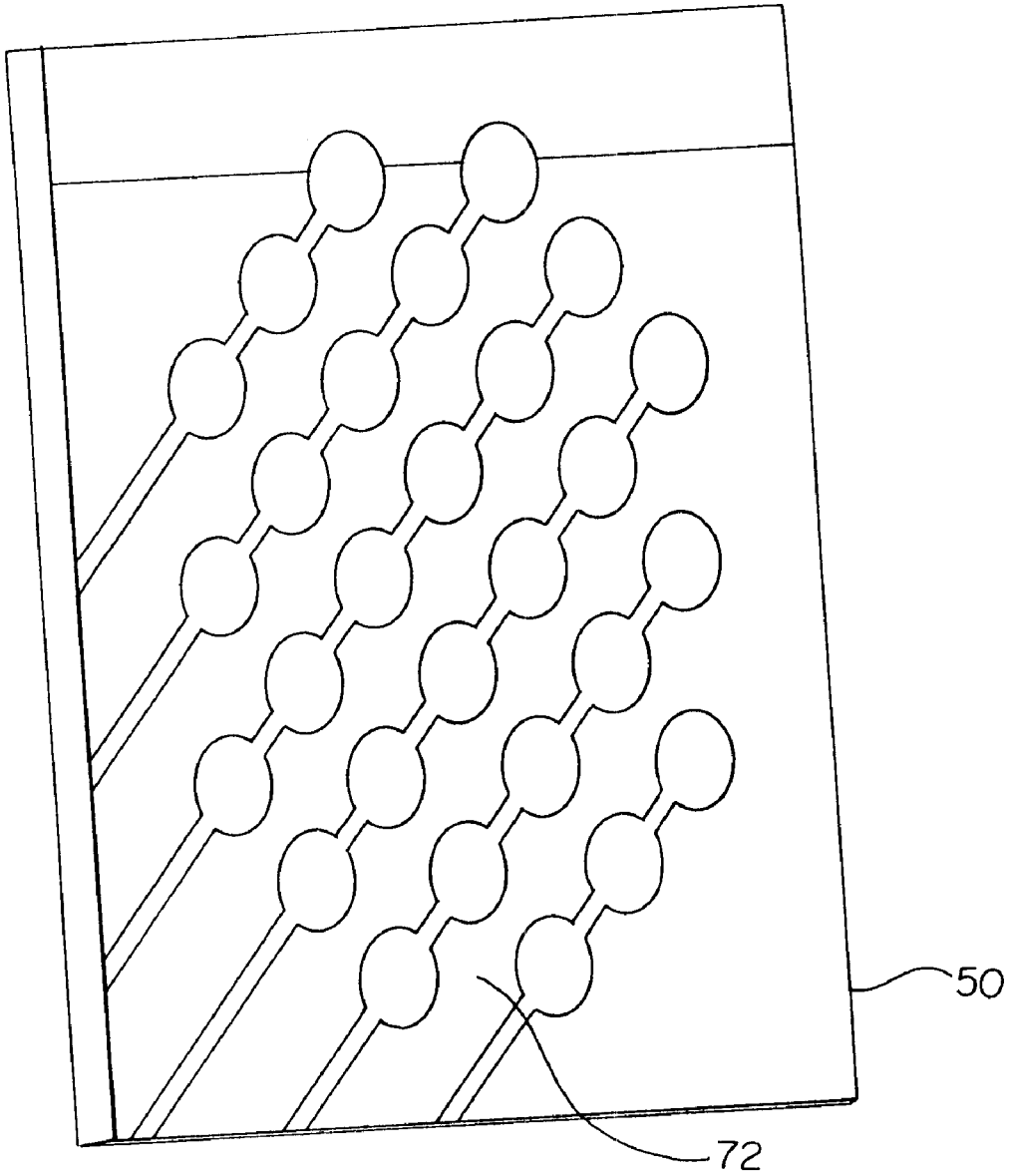
FIG. 7 is a plan view of the underside of an alternative geometry of recesses in a honing head in accordance with the invention.

It will be recognized by those skilled in the art that either side of a disc may be microburnished in the fashion described, but that the honing head is then to be configured to direct particulates toward the outer diameter of a disc, and furthermore the contact force supplied to the head is to be adjusted to compensate for gravity. Further in the present example, although the gimbal cutout 44 (which acts as a suspension spring) is of stress relieved stainless steel, other metals that may provide similar pressure characteristics, such as aluminum, titanium, and copper and various alloys, can alternatively be used. It will also be recognized by those skilled in the art that other configurations of depressions and concavities may be employed, along with other outlines of arrays. In FIG. 7, for example, the contact surface includes a substantially circular array of oval-shaped depressions 72. In another form, the depressions may be of triangular shape, with the trailing edge comprising two converging sides of a triangle.

Figure 8:
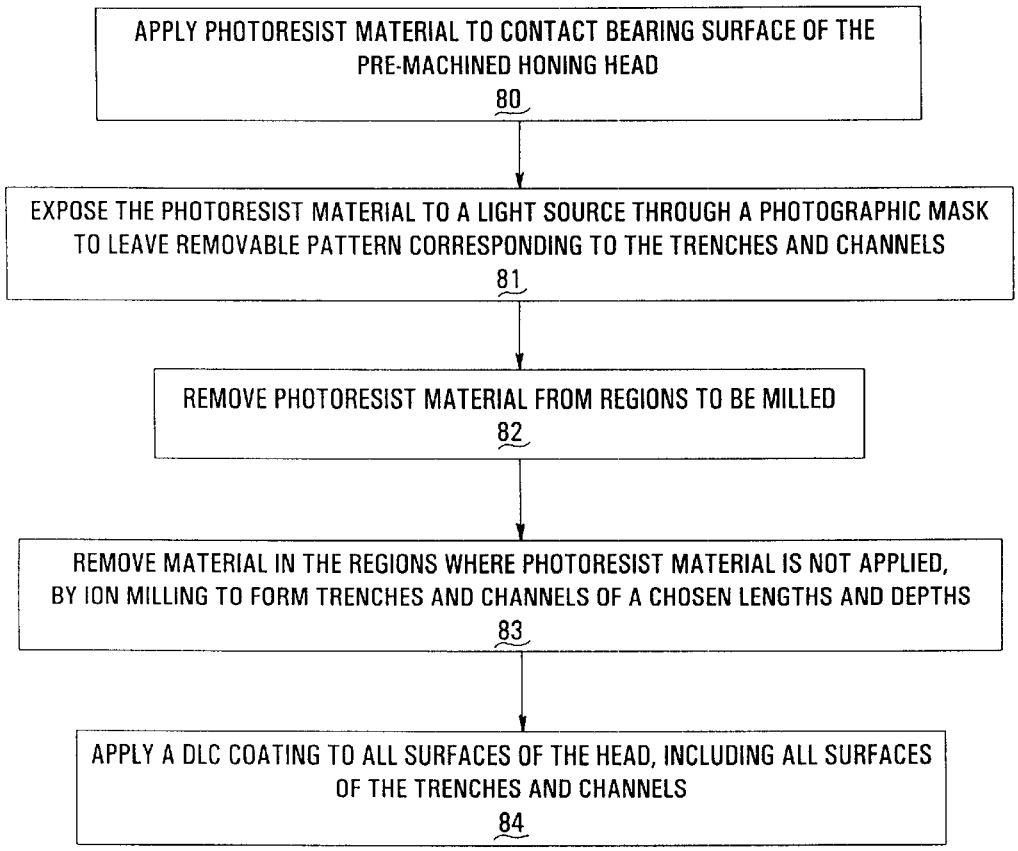
FIG. 8 is a flow chart diagram of steps in a method of fabricating a honing head in accordance with the invention.

The array of recesses or depressions in the honing head may conveniently be formed by modern photolithographic techniques, which enable straight-sided depressions to be formed at precisely controlled depths and with vertical sides for best shearing action, particularly at the small sizes and shallow depths used in this example. Referring to FIG. 8, for example, once the flat surface of the honing head has been prepared, the process for formation of the active surface begins by application of photoresist material uniformly to the contact bearing surface on the honing head 80. The photographic mask bearing the desired pattern is then superimposed for exposure, with or without the use of reducing optics, and the exposure is for a time sufficient to cure the material in the desired pattern 81. A positive or negative photoresist material may be used, as desired.

The photoresist is then washed off or otherwise removed in conventional manner, as by washing 82, and the honing head is treated to remove material in the desired pattern to the chosen depth 83. Although ion milling is preferred because the equipment is used for a number of other purposes as well other conventional techniques such as acid etching, plasma etching and other conventional approaches may readily be used alternatively.

After the configuration of the head has been defined, a dlc coating 84 is applied to all surfaces of the head, including the trenches and channels, to give the desired final properties.

In a preferred embodiment the sliding body comprises an aluminum oxide-titanium carbide material and the honing head has dimensions of less than 0.10 of an inch on a side and the dimensions of the recesses are less than 500 microns on a side.

A method for burnishing a surface of a planar disc to be used in data recording and reproduction is disclosed. The method employs a slider mechanism having an array of surface recesses and at least one channel interconnecting the array of surface recesses. The method includes rotating a planar disc 10 having surface asperities about an axis substantially normal to the disc surface. A surface of the planar disc 10 to be burnished is scanned with a magnetic datahead 20 equipped with a piezoelectric element 24 for detecting asperities, wherein the magnetic datahead is matched in its flight properties to the flight properties of a standard datahead which is later to scan the disc surface in normal operation. Electric signals generated by the piezoelectric element during contact between the datahead 34 and surface asperities are monitored, wherein the electric signals are stored in a computer 30 to locate target locations. The slider mechanism 34 is moved and maintained in substantially parallel relation to the disc at a nominal height from the nominal surface of the disc to a desired target location. Upper surfaces of the asperities are sheared with trailing edges of the surface depressions within the slider mechanism. The sheared asperities are collected at the upper surfaces within the surface depressions and any excess debris is expelled away from disc surface through the channels interconnecting the surface depressions by centripetal forces. The above-mentioned steps are continued until a sufficient surface smoothness is attained.

While a number of forms and variations in accordance with the invention has been described, it will be appreciated that the invention is not limited thereto but encompasses all variations and alternatives within the scope of the appended claims.

We claim:

1. A honing head for burnishing a surface of a planar disc to be used in data recording and reproduction, the head comprising:

a sliding body having a bearing surface with a polished finish;

an array of recesses formed into the bearing surface of the body, wherein trailing edges of the recesses form shearing edged walls; and at least one channel formed into the bearing surface wherein the channel interconnects the array of recesses and extends towards an outer edge of the slider.

2. A honing head as set forth in claim 1 above, wherein the array of recesses includes a geometry in which individual recesses overlap and in which the pattern of recesses includes recesses that are aligned in separate rows, and wherein there are a number of channels each extending through a number of recesses in a different one of the rows.

3. A honing head as set forth in claim 2 above, wherein the array of recesses is arranged in an oval configuration, and wherein the bearing surface includes a diamond-like coating.

4. A honing head as set forth in claim 3 above, wherein the sliding body comprises an aluminum oxide-titanium carbide material, and wherein the honing head has dimensions of less than 0.10 of an inch on a side and the dimensions of the recesses are less than 500 microns on a side.

5. The honing head as set forth in claim 4 above, wherein the recesses are diamond shape, with a trailing edge corner being directed in a direction toward the relative movement of a disc relative to the honing head, and wherein the recesses are of a depth of 10–20 microns.

6. A head for micro-burnishing a nominally flat surface to reduce asperities to less than about 0.5 min. relative to a nominal plane of a flat surface comprising:

hardened planar surface of less than 1/100 $in^2$ in area, the surface including an array of diamond shaped depressions having apices angled in the direction of relative movement between the element and the surface to be micro-burnished and the surface also including a plurality of recessed channels interconnecting depressions in the array with an edge of the element to form outlets for the collected particulate.

7. A head as set forth in claim 6 above, wherein the array of depressions is arranged in rows within the hardened planar surface, and wherein each channel intersects the recesses in a different row.

8. A head as set forth in claim 7 above, wherein the recesses in the array have dimensions of less than about 300 microns on the side, wherein the recesses are of uniform depth of in the range of about 10–20 microns, and wherein the hardened planar surface includes a diamond like coating.

9. A head as set forth in claim 6 above, wherein the diamond shaped depressions are not depressions but are recesses and they are not even diamond shaped because they are of general shape which could be oval or triangular and which have trailing edges which are in communication with the channels that intersects that particular head and furthermore wherein the array of depressions overlaps in a direction transverse to the direction of relative movement between the disc and head so as to cover the entire band and the head has a contact surface that has a chamfer on the leading edge and the outline of the array is curvilinear in shape such as to provide a transition between lesser number of recesses at the sides of the array in comparison to lots of recesses in the middle of the array.

10. Apparatus for reducing disc surface asperities to sub-micro inch height, the apparatus comprising:

a burnishing head; and means disposed on the burnishing head for micro-burnishing a normally flat surface to reduce asperities to less than 0.5 min. relative to a nominal plane of the flat surface.

* * * * *